United States Patent [19]

Salomon et al.

[11] Patent Number: 4,498,687

[45] Date of Patent: Feb. 12, 1985

[54] PIVOTABLE CROSS-COUNTRY SKI BINDING

[75] Inventors: Georges P. J. Salomon; Jean Hue, both of Annecy, France

[73] Assignee: Salomon S.A., Annecy, France

[21] Appl. No.: 335,523

[22] Filed: Dec. 29, 1981

[30] Foreign Application Priority Data

Jan. 6, 1981 [FR] France ..... 81 00358

[51] Int. Cl.[3] ..... A63C 9/10

[52] U.S. Cl. ..... 280/615; 280/618

[58] Field of Search ..... 280/611, 614, 615, 625, 280/626, 628, 618

[56] References Cited

U.S. PATENT DOCUMENTS

| | | | |
|---|---|---|---|
| 4,082,312 | 4/1978 | Johnson | 280/615 |
| 4,235,452 | 11/1980 | Linecker | 280/615 |

FOREIGN PATENT DOCUMENTS

| | | | |
|---|---|---|---|
| 1113887 | 9/1961 | Fed. Rep. of Germany . | |
| 1172586 | 6/1964 | Fed. Rep. of Germany . | |
| 2421602 | 11/1975 | Fed. Rep. of Germany | 280/614 |
| 2907359 | 8/1980 | Fed. Rep. of Germany . | |
| 2907365 | 8/1980 | Fed. Rep. of Germany . | |
| 2304368 | 10/1976 | France . | |
| 2425254 | 12/1979 | France . | |
| 2443853 | 7/1980 | France . | |
| 2447731 | 8/1980 | France . | |
| 2450618 | 10/1980 | France . | |
| 523700 | 7/1972 | Switzerland . | |

*Primary Examiner*—David M. Mitchell
*Assistant Examiner*—Michael Mar
*Attorney, Agent, or Firm*—Sandler & Greenblum

[57] ABSTRACT

A ski binding for securing the front of a ski shoe to a ski. The binding is adapted to permit the heel of the shoe to be lifted vertically while allowing for substantial torsional movement of the shoe after the heel has been lifted to a predetermined extent.

39 Claims, 42 Drawing Figures

PIVOTABLE CROSS-COUNTRY SKI BINDING

BACKGROUND OF THE INVENTION

1. Field of the Invention

The present invention is directed to a ski binding for securing a ski shoe or boot to a ski, and more particularly to a safety binding used in cross-country skiing.

2. Description of Prior Art

Numerous bindings are known for use in cross-country skiing which are adapted to maintain the front end of the shoe or boot secured to the ski while allowing the heel of the shoe to be raised.

French Pat. No. 2,304,368 illustrates a binding in which the front portion of the boot is rigidly and definitely secured during skiing, with the only possible movement of the shoe being the lifting of the heel to allow for walking. To assure a good guidance of the ski during walking (with the ski), the maintenance of the front of the sole must be sufficiently rigid to avoid torsion of the foot around a vertical axis. The greater the lateral rigidity and security, the more accurate is the direction of the skis. However, this advantage is not also without disadvantage. In effect, under these conditions, there is increased danger to the leg of the skier, which can end up in positions where the lateral movement of the foot or its release is necessary to avoid fracture.

Certain manufacturers provide a safety binding for use in cross-country skiing which releases the shoe, as is currently done, and as was long the case in Alpine-type ski bindings. German application Nos. 29 07 359 and 29 07 365 can be cited as examples of such embodiments.

In the above German patents, it is noted that the front of the sole is releasably secured to the ski. The sole is either fixed in a stirrup, or in a jaw which is releasable with respect to the ski. In each of these embodiments, the torsion of the foot along an axis parallel, or not, to the tibia is possible against the force of an elastic energization system. Furthermore, when the torsion reaches a sufficient value, release of the foot of the skier from the ski occurs in the same manner as in Alpine-type bindings.

This type of arrangement is of definite interest with respect to safety, but suffers from undeniable disadvantages with respect to skiability. In effect, the front of the foot is linked to the ski in an elastic fashion. There is thus a poor holding of the shoe, and the elastic maintenance of the shoe does not allow for a very precise steering and direction of the skis.

SUMMARY OF THE INVENTION

The present invention is directed to a ski binding/shoe assembly which is particularly suited for use in cross-country skiing.

The assembly includes a safety-type binding in which the boot is maintained on the ski at its front or toe end. This arrangement allows for the lifting of the heel, as well as the torsional movement of the shoe. Torsional retention means are provided which forbid purely torsional movement, while nevertheless allowing for torsional movement after the heel is raised.

As used throughout the application, the term "safety binding" is intended to include bindings which release the boot allowing for complete separation from the ski, as well as apparatus which allow for displacement of the shoe besides the lifting of the heel, while the shoe remains linked to the ski.

According to the invention, a ski binding is provided for securing one end of a ski shoe to a ski. The binding is adapted to permit the heel of the shoe to be lifted vertically while allowing for substantial torsional movement of the shoe after the heel has been lifted to a predetermined extent. Thus, the shoe can move torsionally to a substantial extent only after at least some vertical movement of the shoe has occurred.

According to one embodiment, the binding comprises an extension extending from the front of the shoe and is secured to the ski by the binding. The extension may contain at least one horizontal pivot axis adapted to permit pivoting of the shoe around a horizontal axis positioned in a plane parallel to the plane of the ski as the heel is lifted.

A pivotable vertical latching element may be provided with the extension being adapted to be pivotably mounted to pivot around the vertical latching element. The vertical latching element may be mounted on a base plate secured to the ski. The latching element is a post with outwardly extending lateral arms and the extension comprises an opening corresponding to the cross-sectional configuration of the vertical latching element. The extension is secured by placing the vertical latching element within the extension and pivoting the latching element to prevent the extension from lifting off of the vertical latching element.

Retention means may additionally be provided for laterally retaining the extension. The retention means laterally retain the extension until at least a portion of the extension is raised upon lifting of the heel.

The extension may further comprise a trapezoidal portion in which case the retention means comprises two corresponding upstanding walls adapted to be fixed relative to the ski.

The extension may have a circular portion, with the base plate having a generally circular upstanding wall ending in the two upstanding walls which diverge according to the configuration of the trapezoidal portion of the extension.

According to an alternative embodiment, the retention means comprises a projection rib adapted to cooperate with a corresponding groove in the shoe, the height of the projection being selected to prevent torsional movement of the shoe unitl the shoe heel is lifted to the predetermined extent.

In yet another embodiment, the extension includes a parallelpipedic portion fitted within an arch. The extension and arch comprise corresponding orifices, with a pin passing through the orifices to secure the parallelpipedic portion of the extension within the arch. The arch is adapted to be pivotably secured onto the ski. Centering means are provided for centering the arch relative to the ski. The centering means may be a plate on which the arch is pivotably mounted. The plate has a seat with a spring-biased bearing being adapted to be positioned in the seat when the arch is centered while allowing for torsional movement of the arch relative to the ski when the extension is subjected to a torsional force sufficient to overcome the bias on the bearing. Again, the binding may include upstanding diverging lateral walls adapted to prevent pivoting of the shoe until after the heel is lifted by the predetermined amount. Alternatively, a projection rib adapted to be mounted on the ski may be used which is adapted to be seated within a corresponding groove on the bottom of the sole of the shoe. The height and dimensions of the rib are selected to permit the torsional movement of the shoe after the heel has been lifted by the predetermined extent.

The shoe may be secured to the ski through a flexion blade adapted to be secured onto the shoe. The flexion blade is to be attached to a pivotable body which is adapted to be pivotably mounted on the ski.

The pivotable body may comprise a spring-biased bearing adapted to be seated in a seat fixed relative to the ski.

Upstanding lateral walls may be provided which are adapted to be fixedly secured to the ski to prevent the torsional movement of the shoe until the heel is lifted sufficiently to raise the heel of the shoe to clear the lateral upstanding walls. Alternatively, a projection rib of the type previously described may be used.

According to yet another embodiment, the binding includes a toe-plate adapted to be secured to the shoe. In this embodiment, a spring-biased piston is used which is adapted to be mounted on the ski. The toe-plate is adapted to be positioned on the ski whereby the piston is biased against a depression on the toe-plate. The toe-plate further has means adapted to cooperate with a sole plate adapted to be mounted on the ski whereby the pressure of the piston against the toe-plate releasably secures the shoe to the ski. To provide lateral security with respect to torsion, a projection rib-groove combination of the previously described type may be used.

The projection rib and grooves may be positioned on either of the sole or ski respectively.

As yet another means of laterally securing the shoe relative to the ski, pointed projections adapted to be mounted on the ski and a pad of soft material adapted to be mounted under the heel of the shoe (or vice-versa) can be used. The projections are adapted to embed within the pad due to the weight of the skier to prevent torsional movement until the heel has been lifted to the predetermined extent.

BRIEF DESCRIPTION OF THE DRAWINGS

The invention will be more specifically described with reference to the annexed drawings, given by way of example only, in which:

In the binding shown in FIGS. 1–32, the boot is connected to the ski by its front end such that a lateral torsional displacement is not possible until after the heel has been lifted while the shoe is connected to the ski at its front end.

FIG. 1 is a longitudinal cross-sectional view of the first embodiment;

FIG. 2 is an elevational lateral view; and

FIG. 3 is a top plannar view.

FIGS. 4–8 illustrate the operation of the first embodiment of the invention.

FIGS. 9–15 illustrate an alternative arrangement of the above first embodiment in which:

FIG. 9 is a view similar to FIG. 8;

FIG. 10 is a longitudinal cross-sectional view;

FIG. 11 is a lateral elevational view; and

FIG. 12 is a top planar view.

FIGS. 13, 14, 15, and 19 illustrate the operation of this embodiment.

FIGS. 16–20 illustrate yet another embodiment in which:

FIG. 16 is a lateral longitudinal cross-sectional view; and

FIG. 17 is a top planar view.

FIGS. 18–20 illustrate the operation of this embodiment.

FIGS. 21–25 illustrate a variation of the previous embodiment in which:

FIG. 21 is a longitudinal cross-sectional view; and

FIG. 22 is a top planar view without the shoe.

FIGS. 23–25 illustrate the operation of this embodiment.

FIGS. 26–32 illustrate yet another embodiment in which:

FIG. 26 is a lateral longitudinal cross-sectional view;

FIG. 27 is a lateral elevational view; and

FIG. 28 is a top planar view.

FIGS. 29–32 illustrate the operation of the previous embodiment.

According to the embodiment shown in FIGS. 33–36 the boot is connected to the ski in a releasable fashion, i.e., after a certain lifting of the heel, total release of the shoe may occur after torsion.

Figure 33:
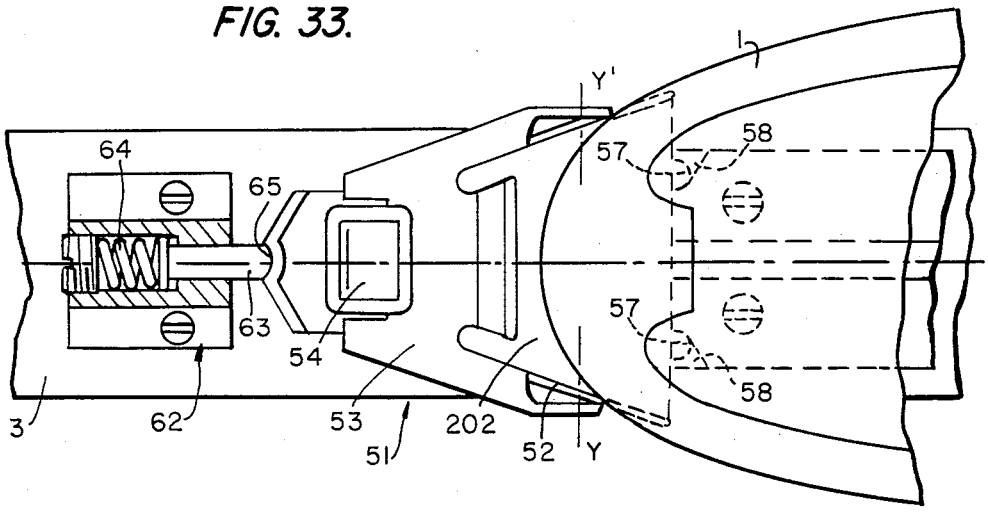
Figure 34:
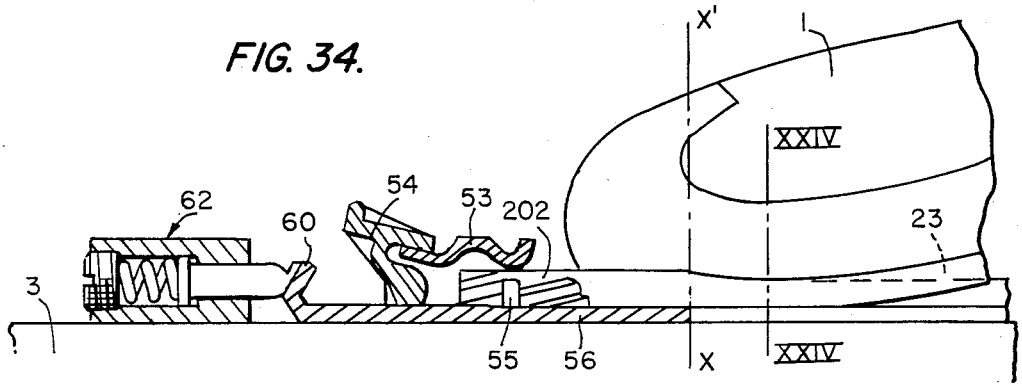

FIG. 33 is a top planar view;

FIG. 34 is a partial longitudinal cross-sectional view; and

Figure 35:
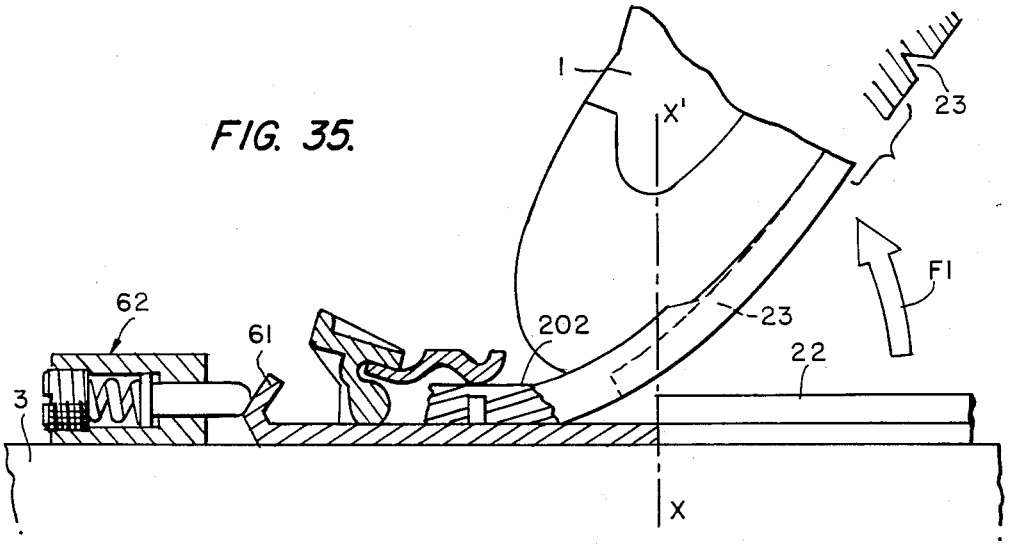
Figure 36:
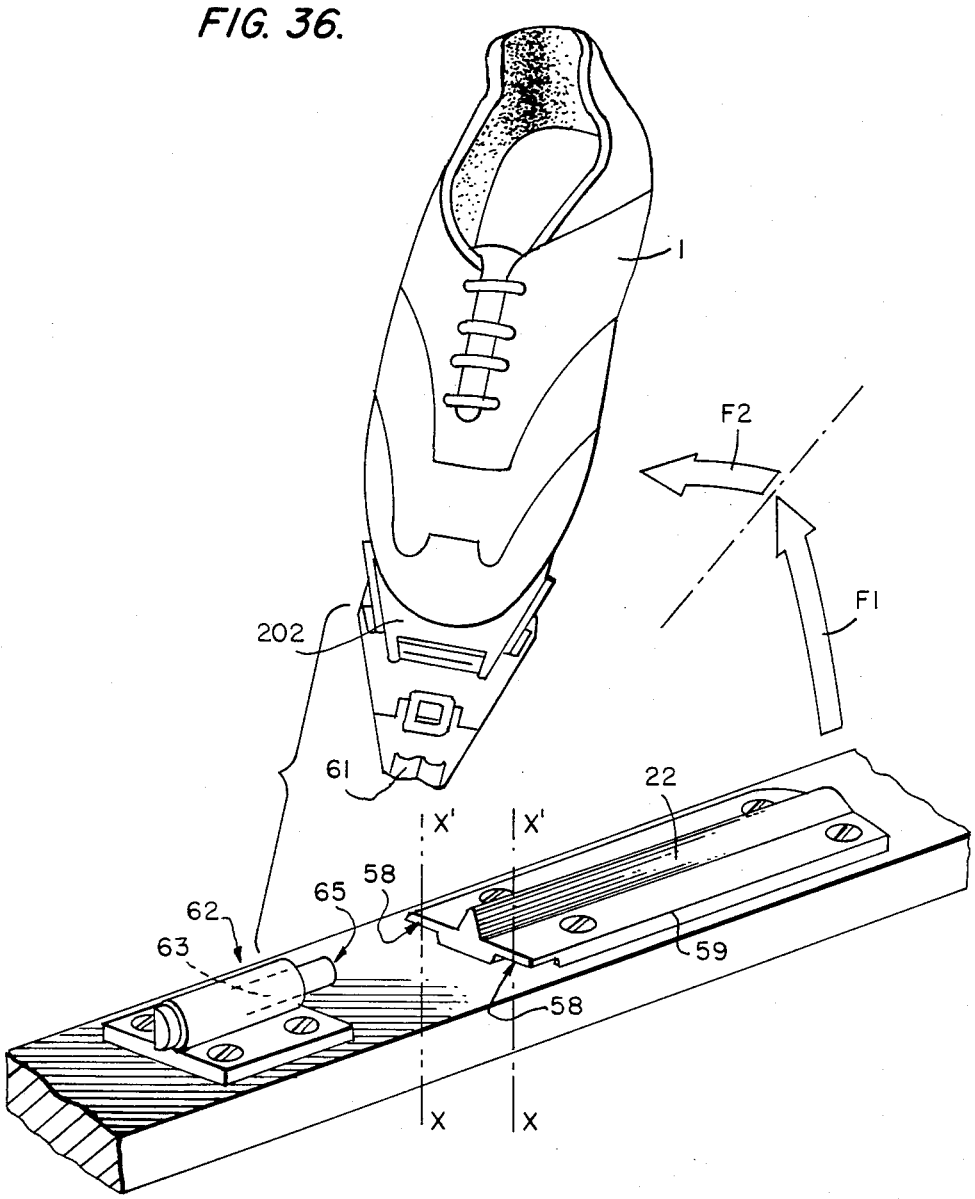

FIGS. 35 and 36 illustrate the operation of this embodiment.

Figure 37:
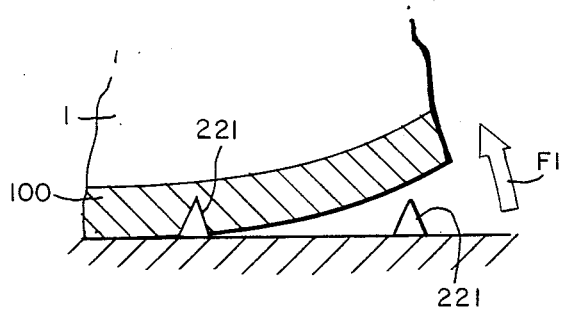
Figure 38:
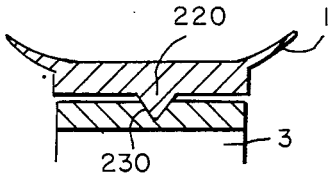
Figure 39:
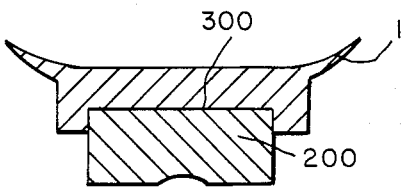

FIGS. 37–39 illustrate alternative embodiments of the torsional retention means.

FIG. 37 is a lateral cross-sectional view; and

FIGS. 38 and 39 are transverse cross-sectional views with respect to the ski.

Figure 1:
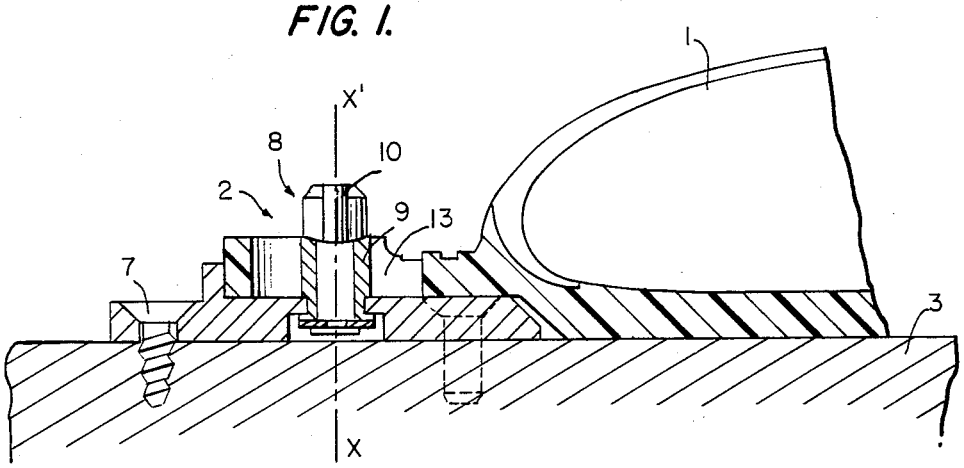
FIGS. 1–8 illustrate a first embodiment.
Figure 2:
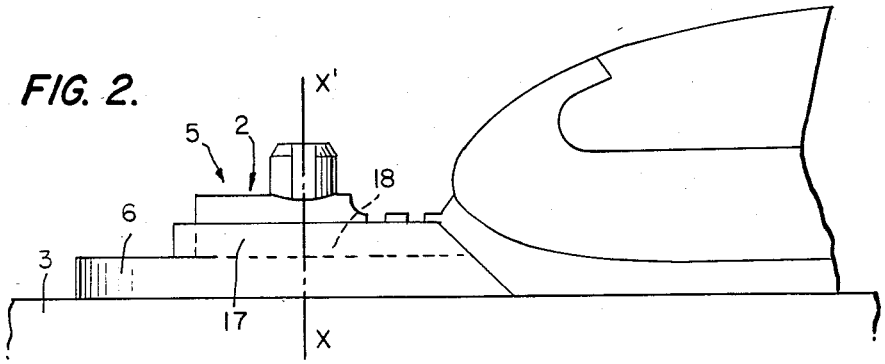
Figure 3:
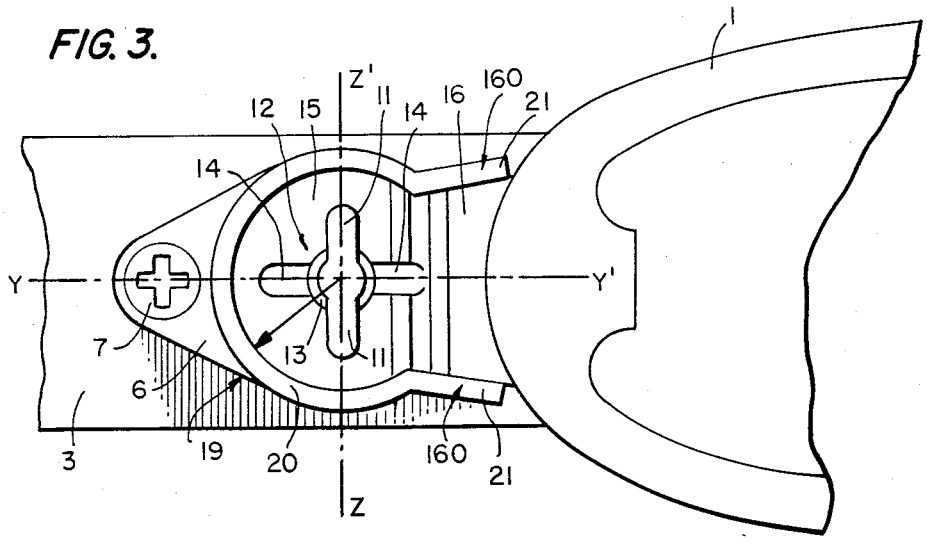
Figure 40:
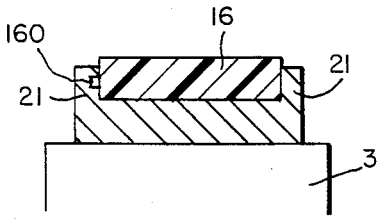

FIG. 40 is a transverse cross-sectional view at the level of the trapezoidal portion (16) of the embodiment of FIG. 3.

DESCRIPTION OF PREFERRED EMBODIMENTS

FIGS. 1–25 and 33–36 illustrate various apparatus in which the boot 1 is maintained on the ski 3 by a front flexible extension 2, 201, 202 such that the lifting of the heel of the shoe is possible, thus permitting the use of the shoe in cross-country skiing.

FIGS. 26–32 illustrate an apparatus in which the boot or shoe 1 is locked onto a flexion blade 41 by virtue of a binding comprising a movable latch 4. In this case, the flexion blade 41 is connected to the ski 3, and allows for the lifting of the heel.

According to one embodiment, the holding of the shoe in response to torsion occurs by virtue of the cooperation of at least one projection with at least one corresponding hollow.

The at least one projection can be integral with the ski, and the corresponding number of hollows can be positioned on the shoe, or, inversely, the projections can be integral with the shoe, while the hollows are integral with the ski. Furthermore, the depression can be formed as a result of cooperation with the corresponding projection, as is shown in FIG. 37.

As used in the application, the term "integral" is used to describe an element which is attached to another element, as well as an element which is constituted by another element itself.

FIGS. 1–8 illustrate an embodiment in which the boot remains attached to the ski even after lateral displacement of the heel. In this embodiment, the shoe or boot 1 comprises a flexible extension 2 at its front. The extension 2 is maintained attached to the ski by a binding 5, which comprises a base plate 6 (FIG. 2) attached to the ski 3 by virtue of screws 7 (FIG. 3). Furthermore, the binding comprises a latching element 8 (FIG. 1) which extends vertically within a maintenance tube 9 so as to be able to pivot around an axis xx'. The latching element comprises a manipulation element 10, which is essentially constituted by two laterally extending arms or wings 11 (FIG. 3) having an axis zz'. The front extension of the shoe 2 contains a cylindrical portion 15 having an axis xx' of rotation and radius r connected to the shoe by a trapezoidal portion 16. The front portion of the extension comprises a latching hole 12 (FIG. 3) having a shape similar in cross-section to the manipulation element 10, and constituted by a hole 13 which extends longitudinally along axis yy' at 14. The binding 5 comprises an exterior body portion 17 (FIG. 2) defining an interior space 18 having a shape and dimension which corresponds to the shape and to the dimensions of the extension of the shoe. This interior space 18 is upwardly open, and is laterally defined by an upstanding wall 19 which extends vertically. This wall 19 is constituted by a generally circular portion 20 having an interior radius r, and extends towards the rear by virtue of two diverging lateral walls or wings 21.

The boot is bound to the ski by positioning the axis zz' of the manipulation element 10 in a longitudinal fashion along the axis yy' so as to be able to engage in the corresponding latching hole 12, 13. When the extension is properly positioned in the space 18, the manipulation element 10 is rotated transversely to latch the shoe, as is shown in FIGS. 1–8.

Figure 4:
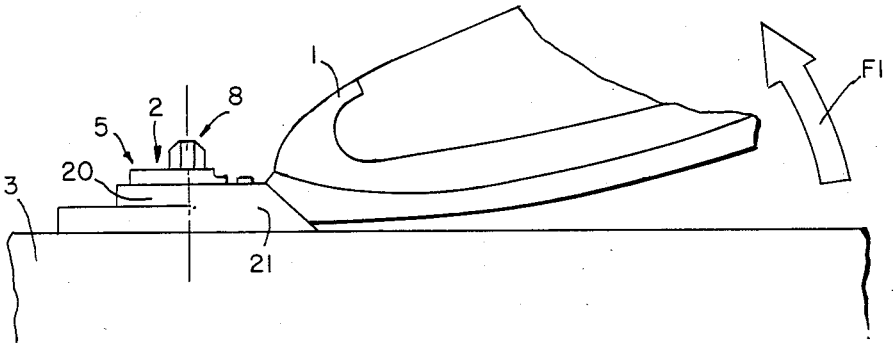
Figure 5:
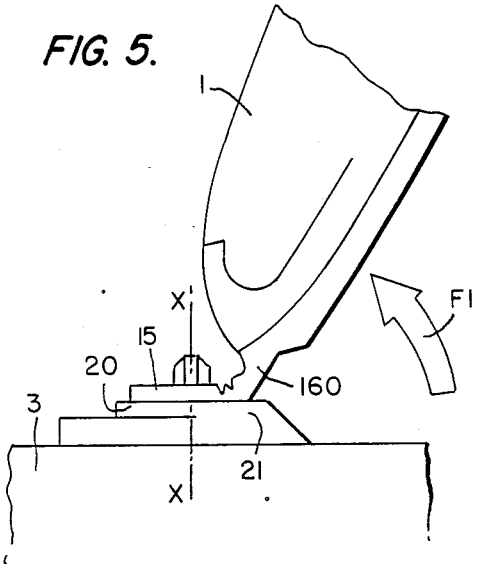
Figure 6:
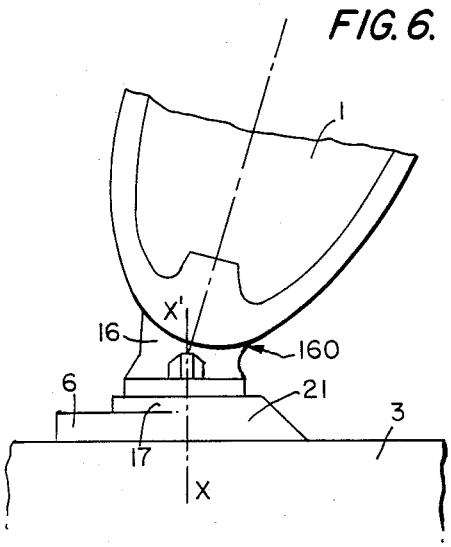
Figure 7:
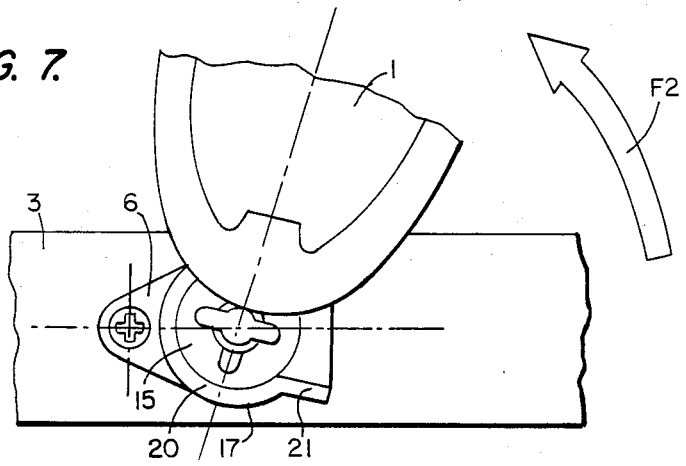
Figure 8:
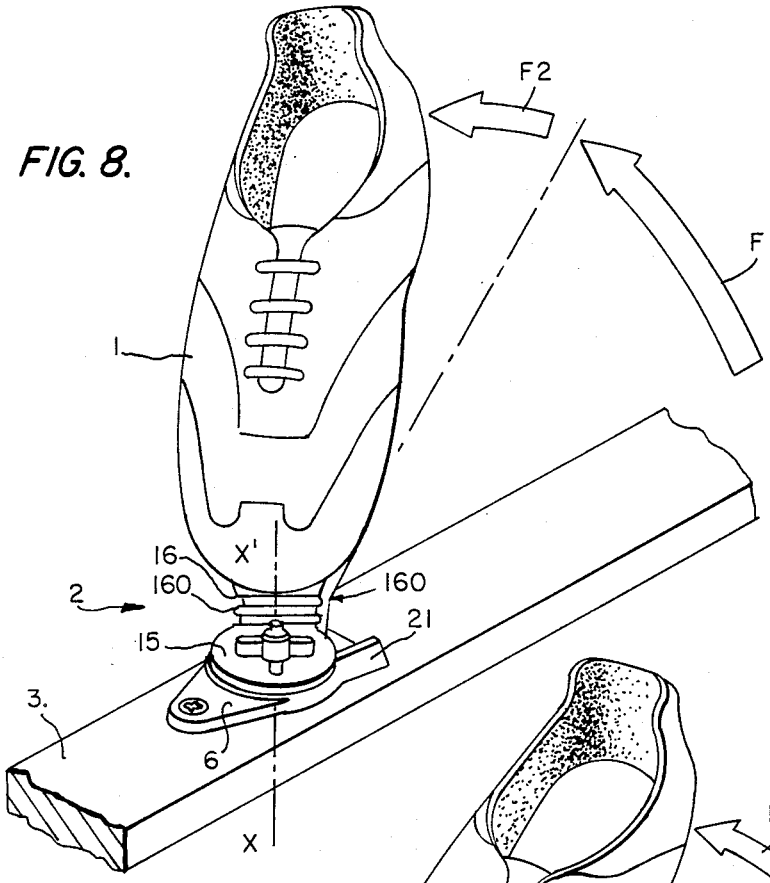

In the locked position, the upstanding lateral wings or walls 21 laterally retain the lateral edges 160 of the trapezoidal portion 16 of the extension, while allowing for the lifting of the heel by flexion of the extension, as is shown in FIGS. 4 and 5. It will be noted, furthermore, that while the trapezoidal portion 16 of FIGS. 1–4 is retained laterally by the walls 21 (FIG. 1), the only possible movement of the shoe is the lifting of the heel along the direction shown by arrow $F_1$, i.e., along the longitudinal vertical plane. However, after a certain amount of vertical lifting of the shoe, which is in effect predetermined by the dimensions of the elements, it is seen (FIG. 5) that the trapezoidal portion 16 is no longer laterally retained by the walls 21, and a torsional displacement of the shoe around the axis xx' along the direction $F_2$ is possible. This movement is shown in FIGS. 6, 7, and 8. There is thus a release during rotation around the axis xx', which reduces the danger of injury in the case of an excessive torsional force, which would otherwise be dangerous to the leg of the skier. It is seen that, in this case, the circular portion 15 of the extension turns within the space 18 around the tube 9, and that the trapezoidal portion 16 clears the exterior body 17.

According to the embodiment shown in FIGS. 9–15, the lateral retention of the boot is not assured by upstanding lateral walls, as in the preceding embodiment, but rather by a projection rib element 22 positioned on the ski, cooperating with a groove 23 provided under the sole of the shoe, at least in the zone of the metatarsus. This type of retention is discussed in U.S. patent application Ser. No. 63,556, now abandoned, the disclosure of which is hereby incorporated by reference. In this type of configuration, elements similar to those in the previous embodiment are designated by the same reference numerals. Again, the shoe, having an extension 2, is provided. The extension is preferably constituted by a cylindrical portion 15, followed by a trapezoidal linkage portion 16; however, this need not necessarily be the case.

The sole comprises, at its lower portion, a recessed or grooved surface 23 extending longitudinally along the axis of the foot. This hollowed cross-section or groove 23 cooperates with the complementary shape of the projecting portion or rib 22, at least during the first phase of the gait. The flexible extension 2 is maintained on the ski by virtue of the binding 50, which comprises, as in the previous case, a base plate 6 which is screwed onto the ski. Again, the latching element 8 is provided, and is positioned pivotably around the axis xx' with its tube 9 and its manipulation element 10. In this embodiment, there is no longer the upstanding circular retention wall 20, nor the upstanding lateral retention wings or walls 21. It is seen that the projection rib 22 extends from the base plate 6 towards the rear, and is integral therewith. However, a different arrangement could be used, e.g., the projection portion 22 could be independent of the base plate 6, and be independently secured to the ski. In the locked position, the shoe or boot is maintained on the ski by the end 15 of its front extension 2. The extension which is made out of a deformable material which is flexible allows for the lifting of the heel and allows for the gait used in cross-country skiing.

Figure 9:
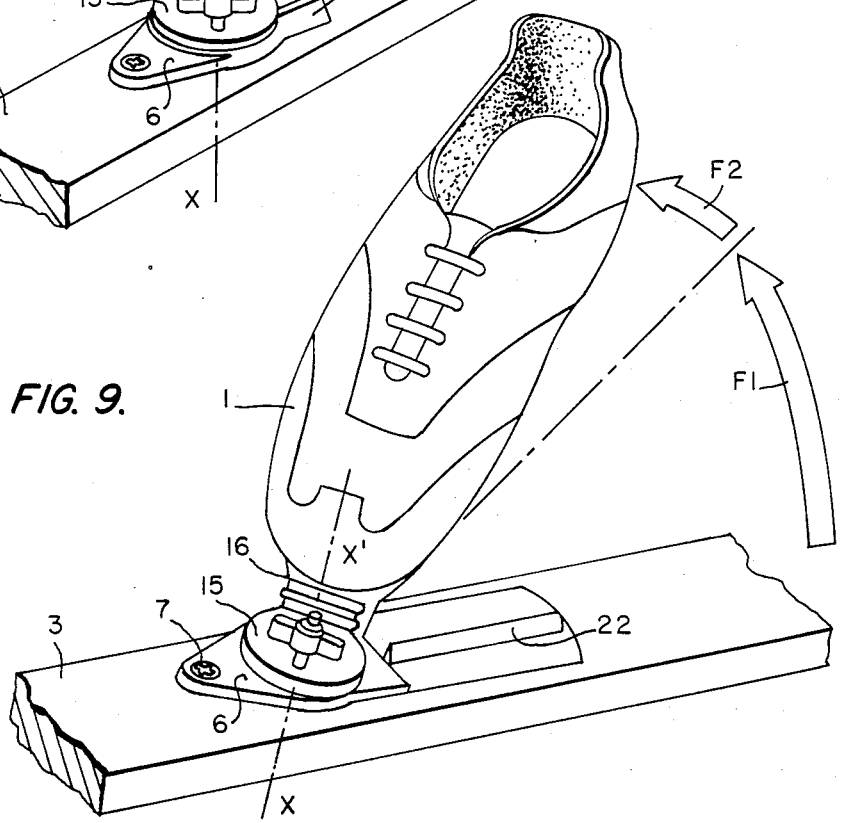
Figure 10:
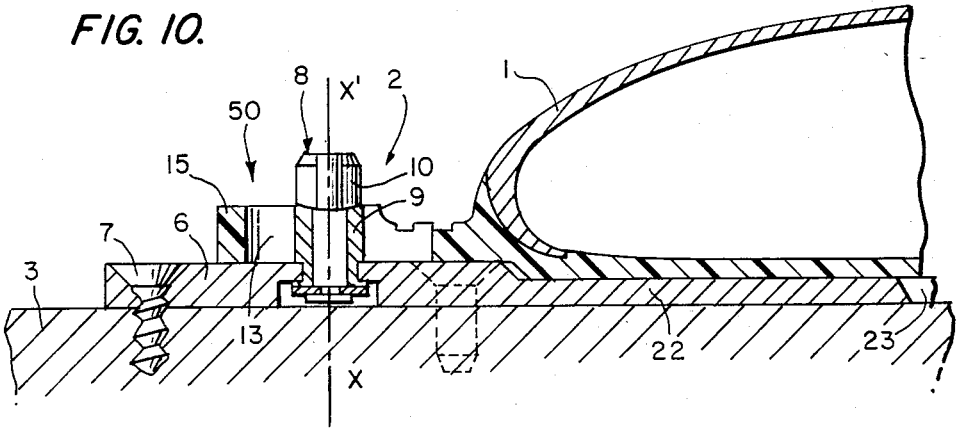
Figure 11:
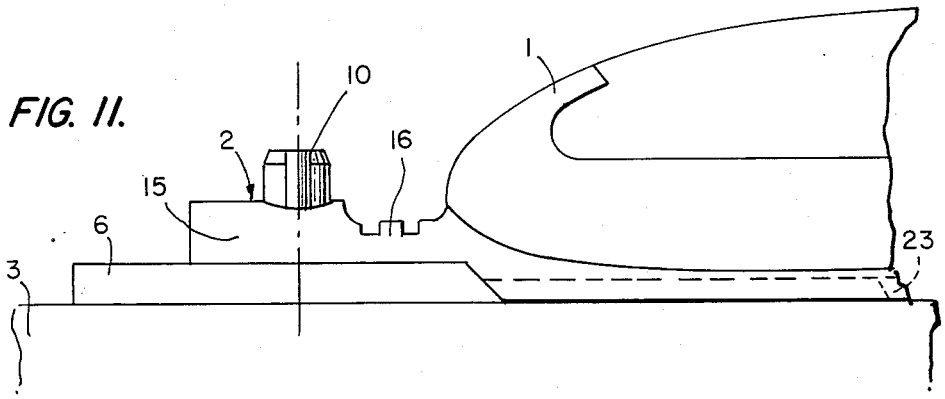
Figure 12:
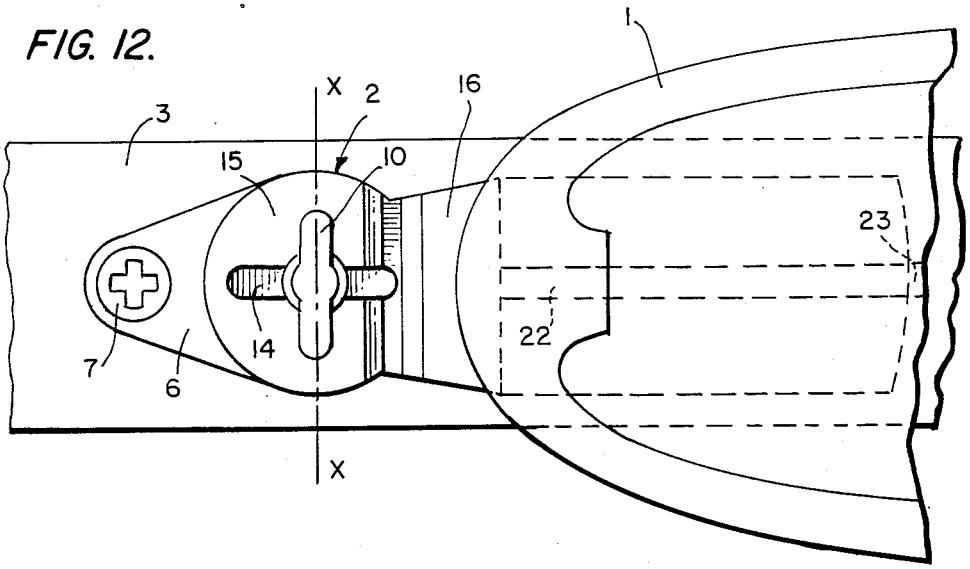
Figure 13:
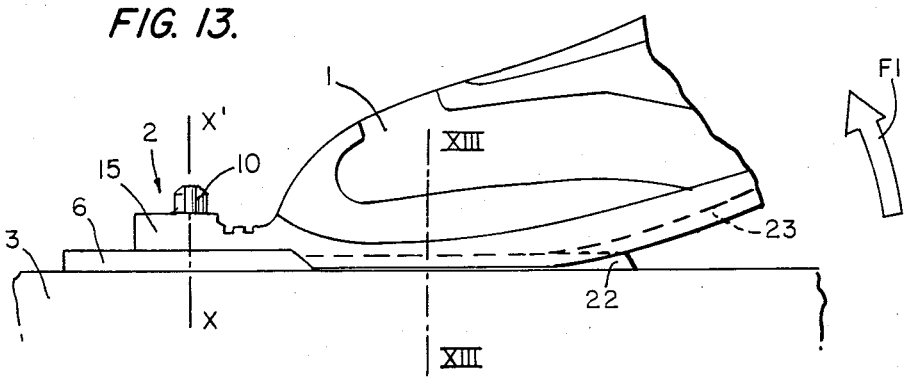
Figure 13A:
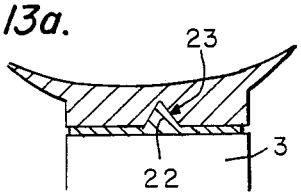
FIG. 13A is a partial cross-sectional view along line XIII—XIII of FIG. 13.
Figure 14:
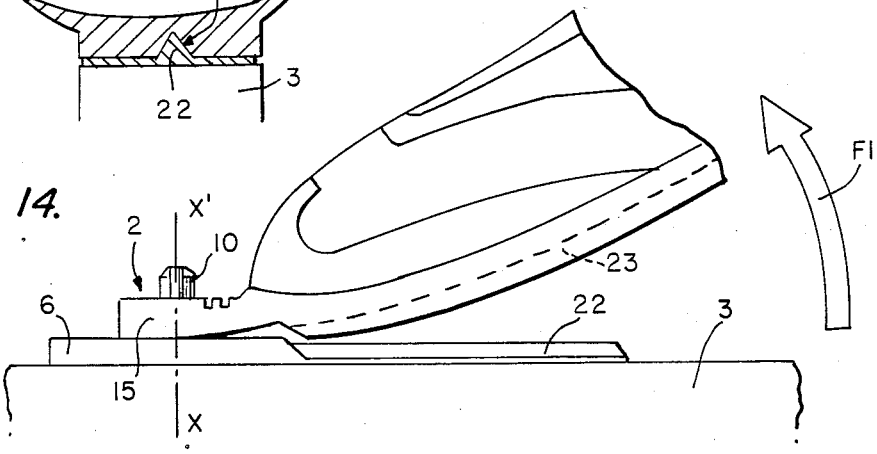
Figure 15:
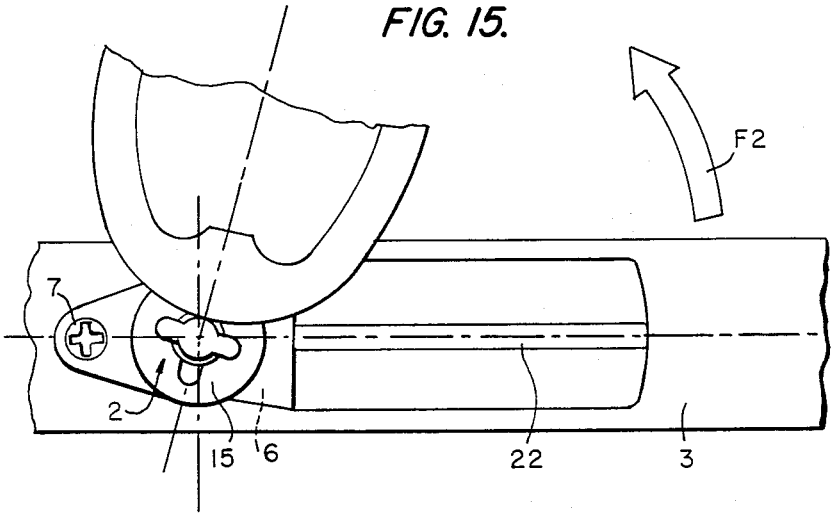
Figure 16:
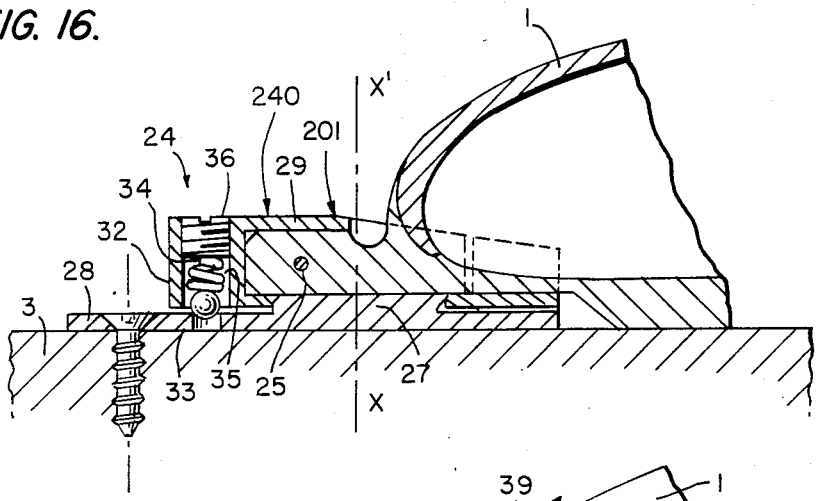
Figure 17:
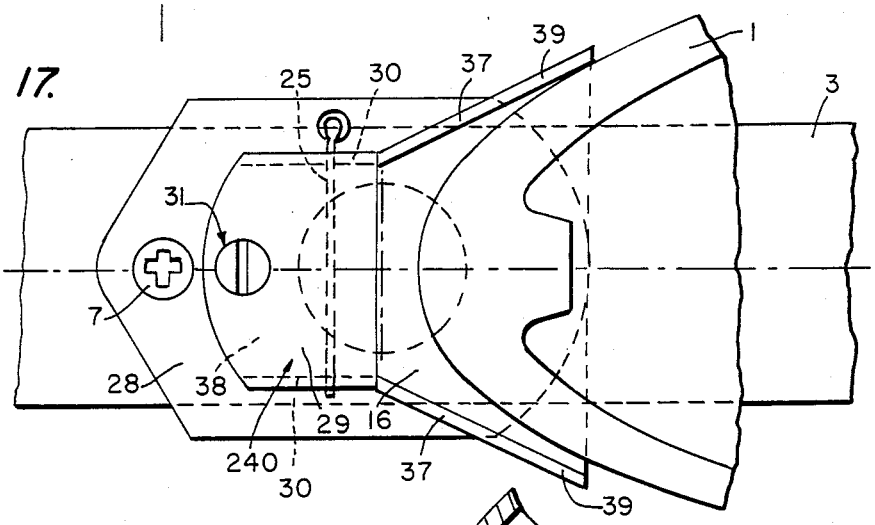

As seen in FIGS. 10, 11, 12, and 13, the shoe is laterally retained by cooperation of the projection rib 22 with the corresponding hollow recess or groove 23 of the shoe. Only the raising of the heel along the direction $F_1$ in the longitudinal plane which is vertical relative to the ski is possible. After a certain amount of vertical lifting of the heel has occurred, it is seen (FIGS. 9 and 14) that the cooperation between the projection portion 22 and the hollowed portion 23 is cleared, and, as a result, the shoe is no longer laterally secured. Under these conditions, a torsional movement of the shoe along the direction $F_2$ along the axis xx' is made possible (FIGS. 9 and 15). This movement minimizes, as in the previous case, the danger of injury in the case where an excessive torsional force may be dangerous to the leg of the skier. In this embodiment, the boot remains linked to the ski, even after torsion of the foot.

Furthermore, it is very possible, without going beyond the scope of the invention, to assure the retention in torsion, both by the wings 21 and by a projection 22, or even by a plurality of projections 22.

FIGS. 16–25 illustrate another embodiment, in which the extension 201 of the boot is maintained in the binding 24 by a transverse pin 25. The extension 201 is parallelpipedic, and is engaged under arch 240, pivotably positioned on ski 3 around an axis xx'. To do this, the lower portion of the arch comprises a hole 26 in which a pivot 27 which is integral with the base plate 28 is lodged. The base plate is attached to the ski 3 by screws 7, as in the preceding embodiment. The arch comprises an upper retention portion 29 and two lateral parallel portions 30 which define a volume in which the extension 201 of the shoe is engaged and locked.

Figure 18:
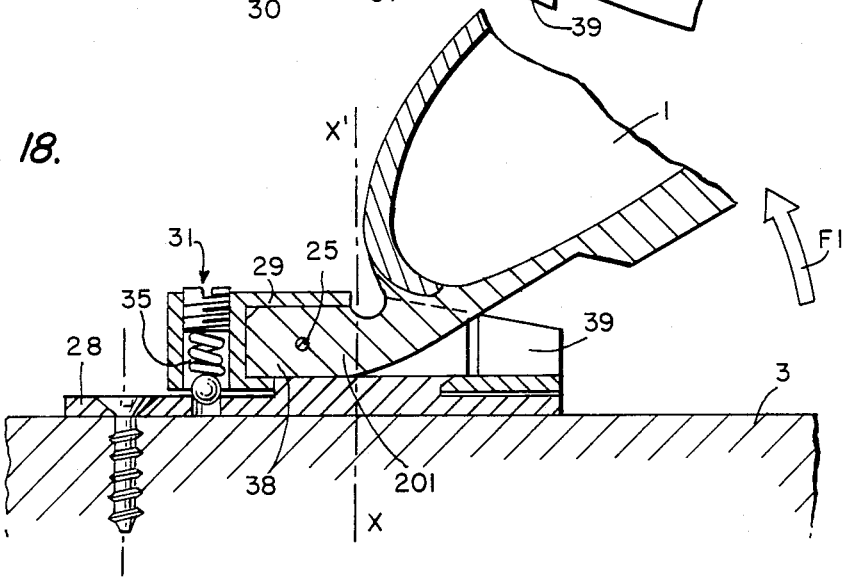
Figure 19:
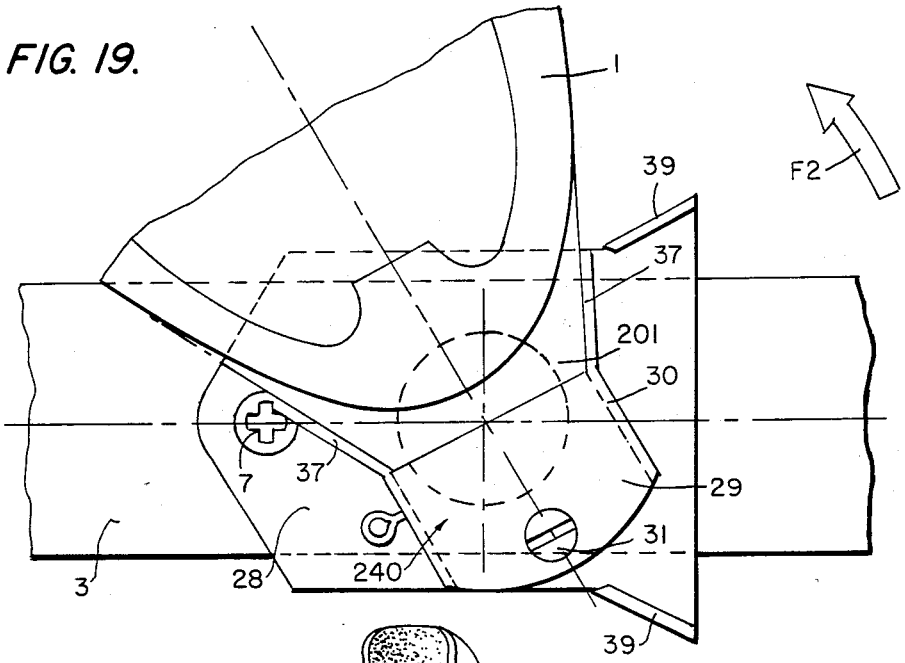
Figure 20:
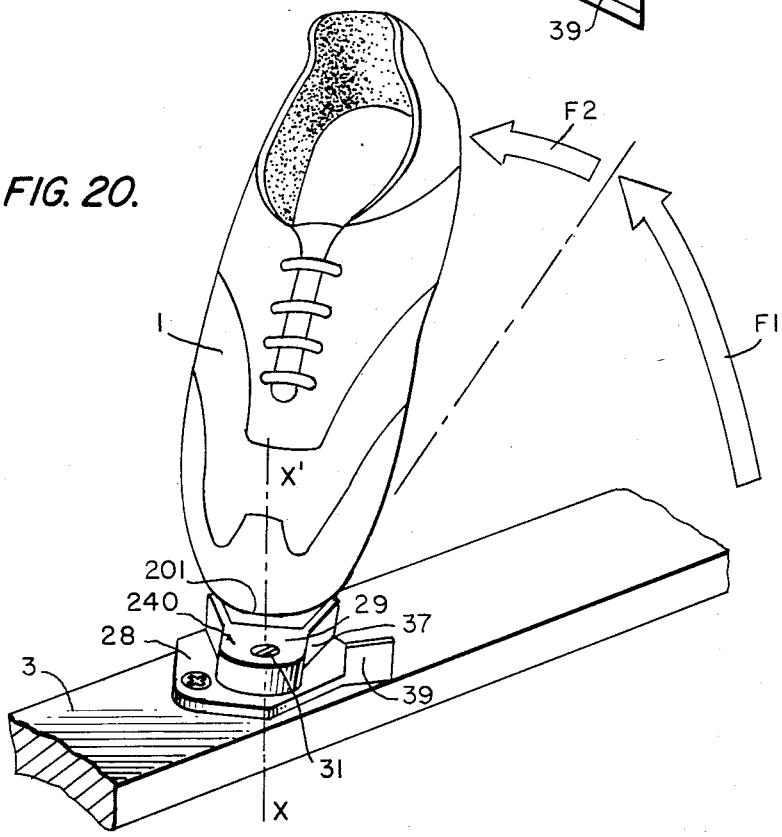
Figure 21:
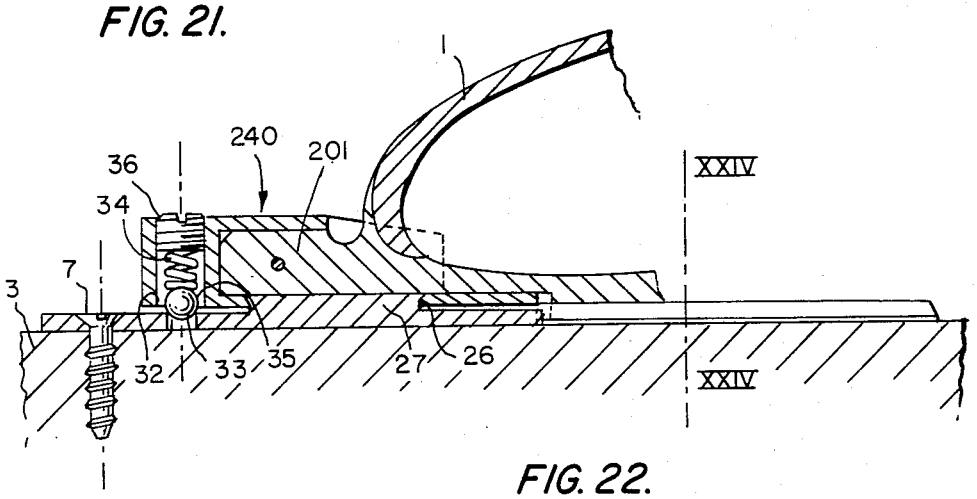
Figure 22:
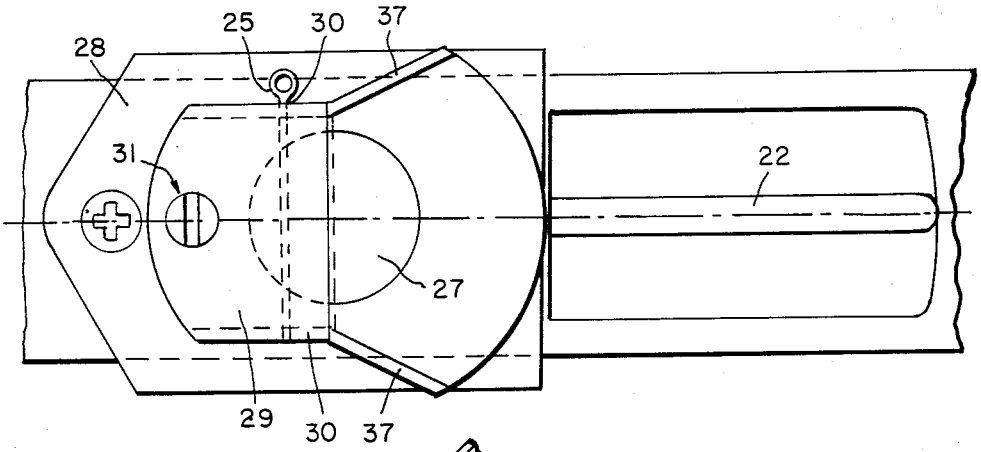

It will be noted that the arch is maintained in a centered position by virtue of a latching apparatus 31 constituted by a bearing 32, which is biased in a latching seat 33 by the force of spring 34. The bearing 32 and spring 34 are positioned in a vertical hole 35 provided in the front portion of the arch. The latching seat 33 is provided in the base plate 28. An adjustment screw 36 can be provided to adjust the initial resistance of the spring 34. The lateral portions 30 of the arch 240 extend rearwardly in the form of diverging walls 37. The extension 201 of the boot comprises, at its front end, a parallelpipedic portion 38 connected to the shoe or boot by a trapezoidal flexional element 13. The boot is furthermore retained laterally by a stirrup formed by two lateral retention walls 39 integral with the base plate 28. These two lateral retention wings are positioned vertically in the extension of the diverging walls 37. As in the embodiment shown in FIGS. 1–8, lateral retention wings 39 are attached with respect to the ski, and maintain the shoe laterally as long as the heel of the shoe is not lifted too much with respect to the ski. When the lifting of the heel has reached a certain point, as is shown in FIGS. 18, 19, and 20, the boot is no longer laterally retained by the wings 39, and torsion of the foot, along the direction $F_2$, is possible after release of the latching system 31.

Figure 23:
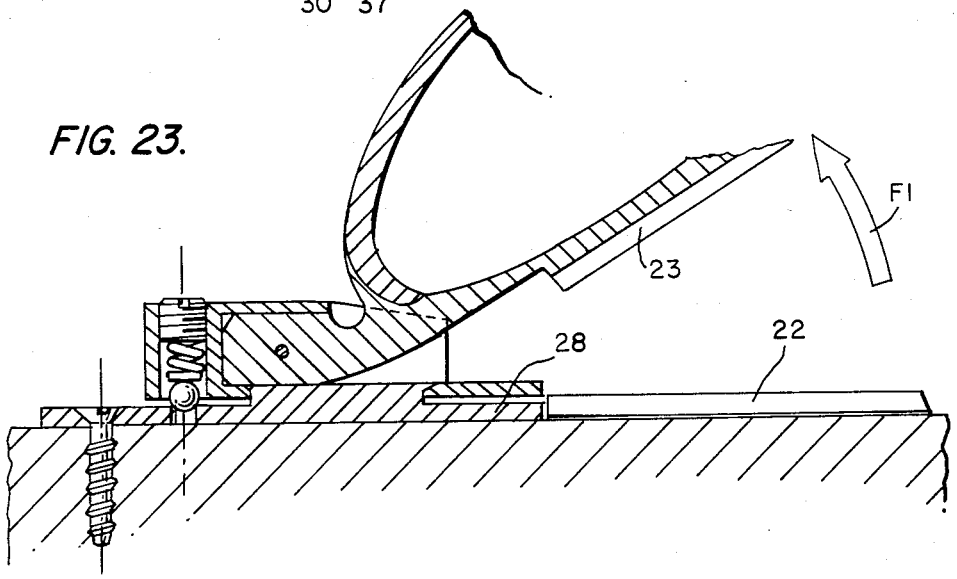
Figure 24:
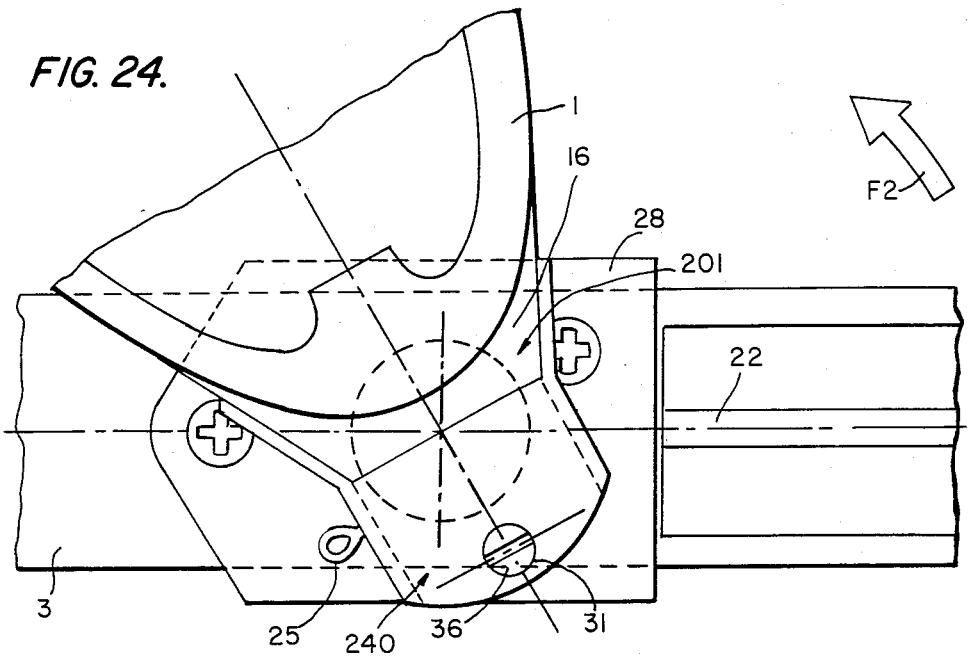
Figure 24A:
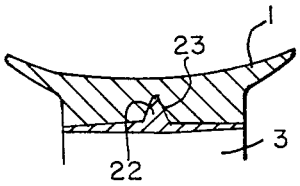
FIG. 24A is a cross-sectional view along line XXIV—XXIV of FIG. 26.
Figure 25:
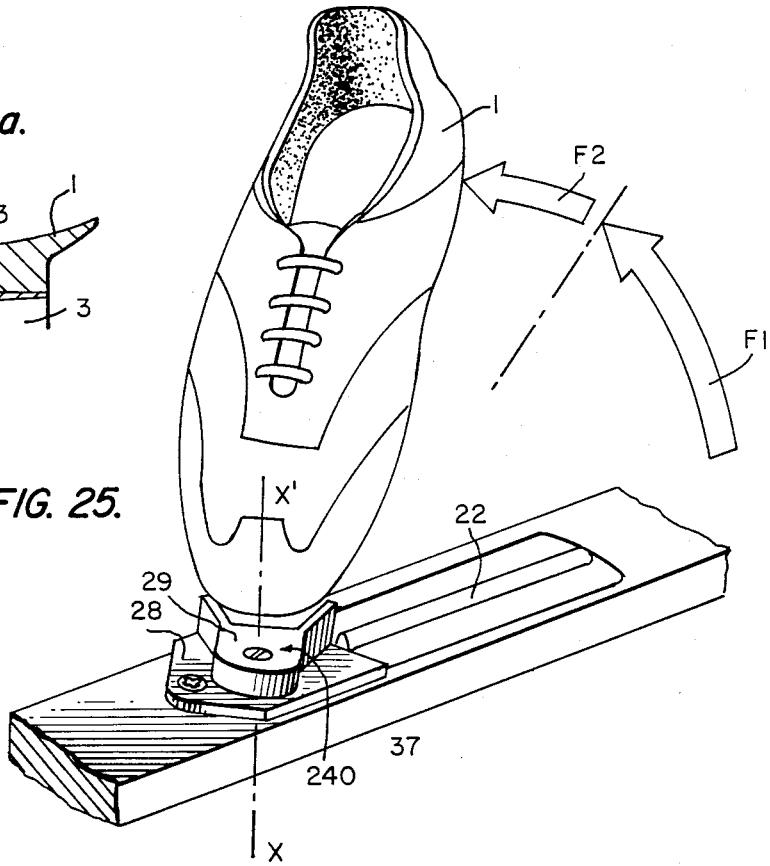
Figure 26:
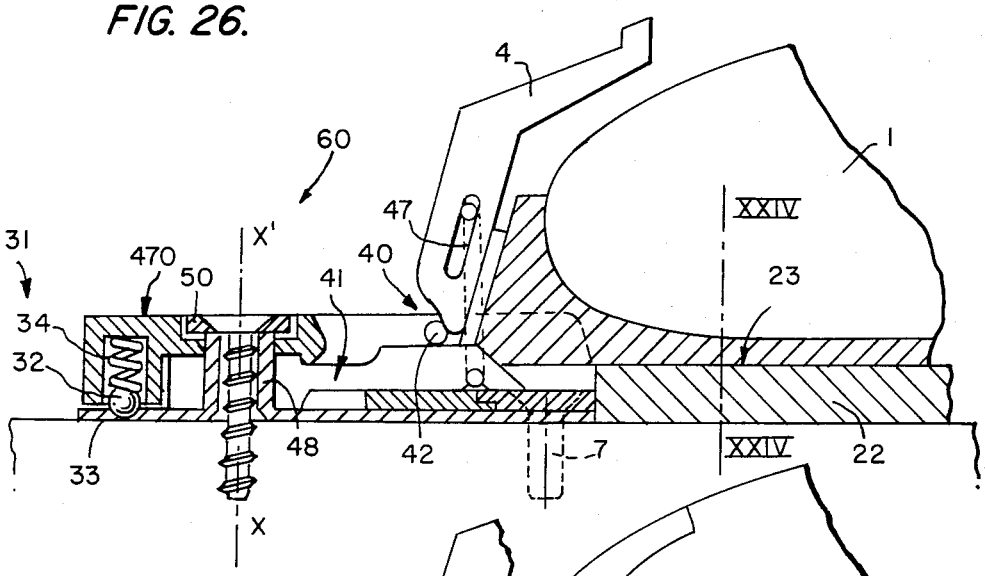
Figure 27:
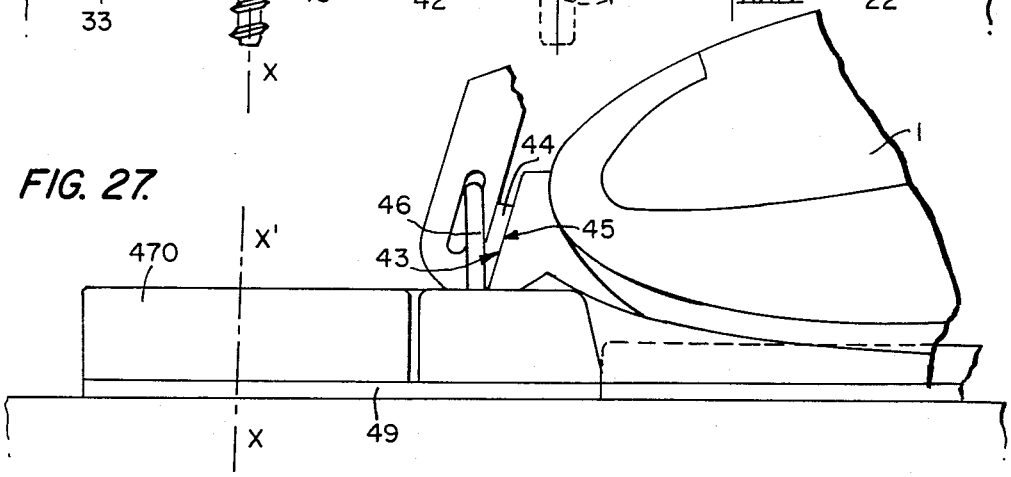
Figure 28:
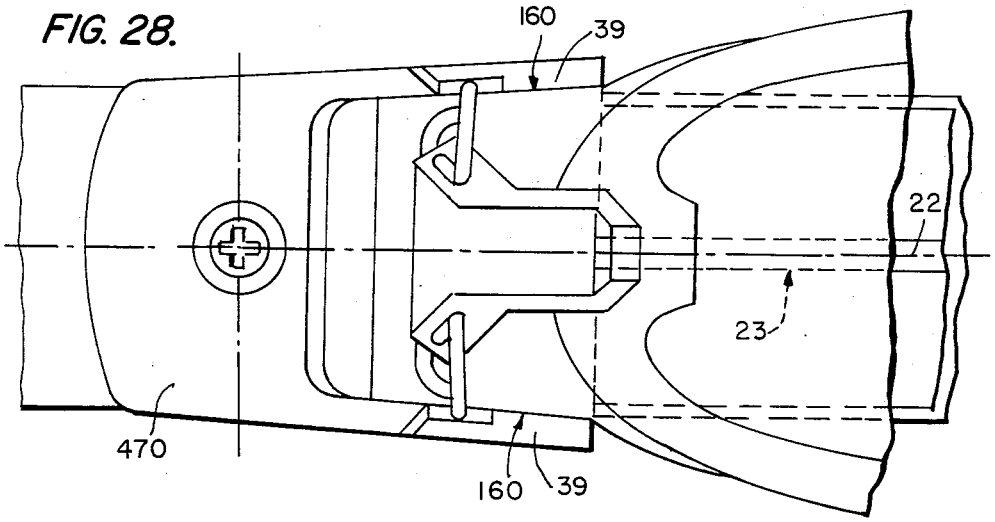

In the embodiment shown in FIGS. 21–25, the lateral retention means 29 are eliminated, and replaced by a longitudinal projection rib 22, as in the embodiment shown in FIGS. 9–15. The shoe comprises a hollowed corresponding groove 23. As in the embodiment of FIGS. 9–15, a torsional movement of the foot along the direction $F_2$ is not possible, other than when the cooperation between the projection 22 and the groove 23 is overcome (FIGS. 23, 24, and 25). It is self-evident that one can, to assure lateral retention against torsion, utilize both the wings 39 and the projection 22, and that the latching system 31 can be eliminated to allow for complete freedom of rotation of the arch around the axis xx'.

As has been shown above, in the embodiment of FIGS. 26 and 32, the boot 1 does not comprise a flexible extension, but a latching element 40, which extends from its front portion. The shoe is attached, by means of this latching element 40, on a flexion blade 41. This type of apparatus is shown in U.S. patent application Ser. No. 116,847, the disclosure of which is hereby incorporated by reference, and need not be described in further detail. It need only be noted that the shoe comprises, at its front portion, a latching element 40, which is constituted by a transverse bit 42 which is offset with respect to the front portion of the shoe, which comprises a support zone 43. Furthermore, the flexion blade 41 comprises a support element 44 which is adapted to be introduced between the transverse bit 42 and the support zone 43 of the shoe. The support element 44 comprises an abutment zone 45, and the latching of the shoe on the blade occurs by virtue of a movable latch 4 journalled on a mounting 46, and elastically biased by an elastic system 47 contained in the movable latch. The flexion blade 41 is positioned in an opening constituted by a body 470. The flexion blade assembly 41 and body 47 are pivotably mounted around an axis xx' constituted by a pin 48, integral with a base plate 49 attached to the ski by screws 7, with one of the screws being placed in a bore along an axis of the pin 48. The vertical retention of the assembly is assured by a washer 50. Furthermore, the assembly is centered by a latching system 31 constituted by a bearing 32, biased elastically by a spring 34 in an opening 33 of the base plate 49. In this embodiment, the retention during torsion around the axis xx' is assured, on the one hand, by the latching system, as well as, in the preceding case, either by two lateral retention wings 39, or by a projection rib profile 22, or by both the wings 39 and the projection profile, as is the case in FIGS. 26–28. As in the preceding embodiments, the retention wings 39 cooperate with the lateral edges 160 of the sole, and the projection rib profile 22 cooperates with a hollow provided in the sole of the shoe or boot. It should be remembered that lateral retention is eliminated when the heel of the shoe is sufficiently lifted, as is the case in the preceding embodiments.

Figure 29:
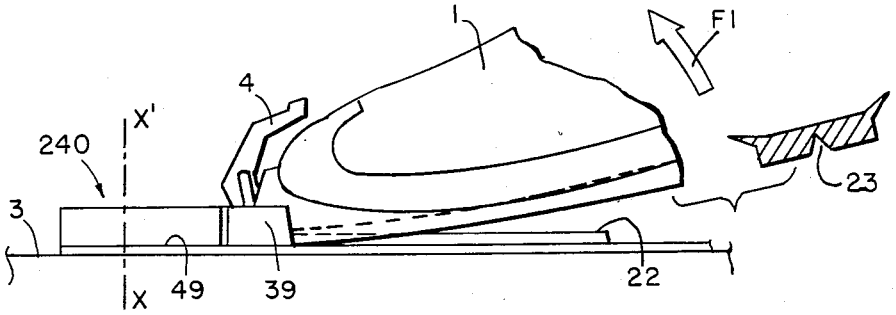
Figure 30:
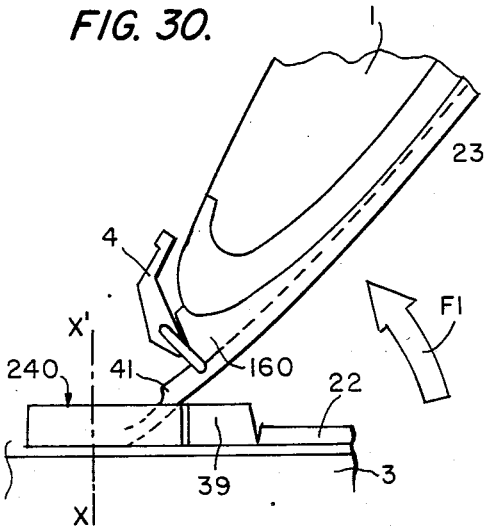
Figure 31:
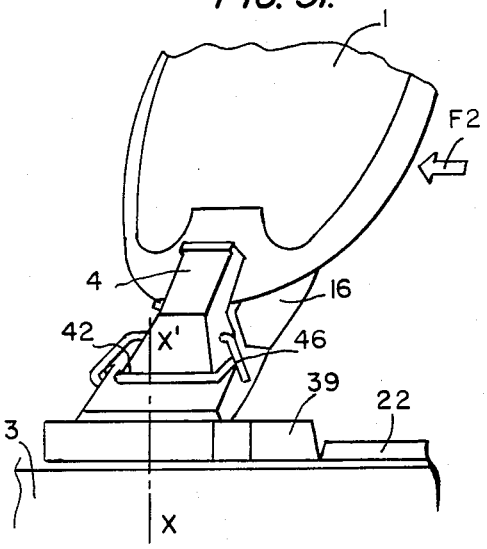
Figure 32:
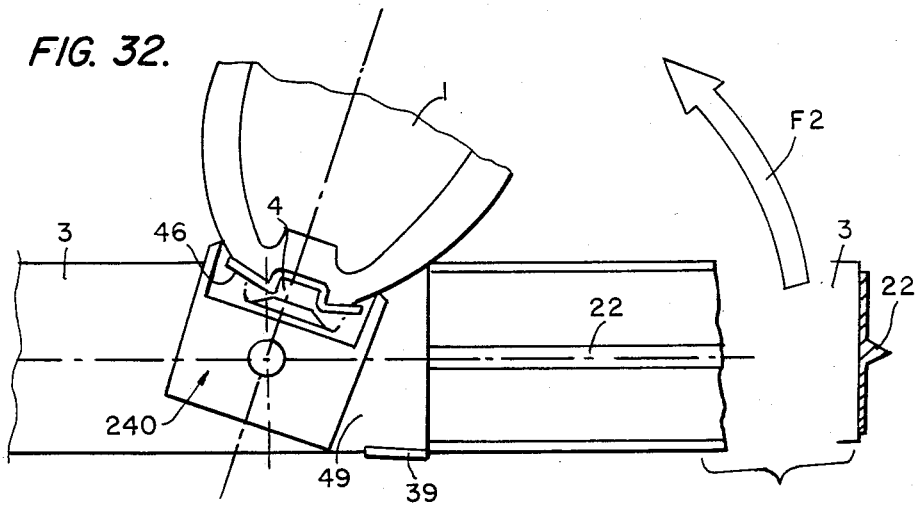

FIG. 29 illustrates that the boot is further retained against torsion for a slight lifting of the heel along the direction $F_1$. FIG. 30 illustrates that if the lifting of the heel in the direction $F_1$ is substantial, there is a release of the retention means during torsion, and a rotational movement of the foot around the axis xx' along the direction $F_2$ is possible (see FIGS. 31 and 32). It should be noted that one does not go beyond the scope of the invention if the latching system 31 is eliminated.

FIGS. 33–36 illustrate an apparatus in which, contrary to the preceding embodiments, the attachment between the shoe and the ski can be totally eliminated to completely free the shoe when an excessive torsion, combined with a substantial lifting of the heel, occurs. In this embodiment, the front end 202 of the shoe is maintained in the apparatus 51 attached to the ski in a releasable manner. The apparatus 51 is, for example, of the Normes-Nordic type, and comprises a stirrup 52 on which is mounted, in a pivotable manner around an axis yy', a maintenance element 53 retained in the maintenance position by a lock 54. The shoe is maintained longitudinally in the apparatus 51 by three vertical projections 55. Stirrup 52 is mounted on a base or toe-plate 56, which comprises two projections at its rear which are positioned on both sides of the longitudinal plane of symmetry of the ski. These two projections are adapted to be positioned in two corresponding hollows 58 in a rear plate 59 attached to the ski. Furthermore, at its front portion, the base plate comprises a vertically extending wall 60, and comprising a latching hole or depression 61. A latch casing 62 is attached to the ski, and comprises a sliding piston 63 whose end 65 is biased by a spring into the latching hole to 62. The apparatus 51 is thus elastically maintained on the ski by the system which maintains the projections 57 in the corresponding hollows 58. In this embodiment, one can also assure the retention against torsion by lateral retention wings identical to those identified by reference numerals 21 or 39 in the preceding embodiments.

FIGS. 37–39 illustrate other embodiments for laterally securing the shoe with respect to torsion.

FIG. 37 illustrates an embodiment in which the projection rib 22 of the preceding embodiment is replaced by a succession of conical points 221 positioned to be embedded in a soft material constituting the sole 100 of the shoe.

In the embodiment of FIG. 38, the projection rib 220 is integral with the shoe, and the hollow recess or groove 230 is attached to the ski 3.

In the embodiment of FIG. 39, it will be noted that the ski 3 itself forms the projection rib 200 cooperating with a corresponding hollow recess 300 provided under the sole.

Furthermore, regardless of the particular embodiments used, the projection rib and groove may be provided with corresponding triangular or parallelpipedic configurations.

FIG. 40 illustrates how retention with respect to torsion is achieved in an embodiment such as that of FIG. 3 in the case where retention wings of the type identified with numerals 21 and 39 are used.

Although the invention has been described with reference to particular means and embodiments, it is to be understood that the invention is not limited to the particulars disclosed, and extends to all substitutes and equivalents included within the scope of the claims.

What is claimed is:

1. A ski binding comprising means for securing the front of a ski shoe to a ski, and wherein said binding further comprises means permitting the heel of said shoe to be lifted vertically while allowing for substantially free torsional movement of said shoe around a vertical axis of said binding after said heel has been lifted to a predetermined extent, and wherein said binding further comprises means for preventing lateral movement of said shoe until said heel has been lifted to a predetermined extent.

2. The ski binding as defined by claim 1 wherein said binding is adapted whereby said shoe is freed to move torsionally only after at least some vertical movement of said shoe has occurred.

3. The ski binding as defined by claim 2 further comprising an extension extending from the front of said shoe, said extension being secured to said ski by said binding.

4. The ski binding as defined by claim 3 wherein said extension comprises at least one horizontal pivot axis adapted to permit pivoting of said shoe around a horizontal axis positioned in a plane parallel to the plane of said ski as said heel is lifted.

5. The ski binding as defined by claim 3 further comprising a pivotable vertical latching element, said extension being adapted to be pivotably mounted to pivot around said vertical latching element.

6. The ski binding as defined by claim 5 further comprising a base plate adapted to be secured to said ski, said vertical latching element being mounted on said base plate.

7. The ski binding as defined by claim 6 wherein said vertical latching element comprises outwardly extending lateral wings and wherein said extension comprises an opening corresponding to the cross-sectional configuration of said vertical latching element whereby said extension is secured by placing said vertical latching element within said extension and pivoting said latching element to prevent said extension from lifting off of said vertical latching element.

8. The ski binding as defined by either of claims 3 or 7 comprising retention means for laterally retaining said extension.

9. The ski binding as defined by claim 8 wherein said retention means laterally substantially retain said extension until at least a portion of said extension is raised upon lifting of said heel.

10. The ski binding as defined by claim 9 wherein said extension comprises a trapezoidal portion and wherein said retention means comprises two upstanding walls adapted to be fixed relative to said ski.

11. The ski binding as defined by claim 10 further comprising a base plate adapted to be secured to said ski and wherein said extension further comprises a circular portion, said base plate comprising a generally circular upstanding walls ending in said two upstanding walls which diverge according to the configuration of said trapezoidal portion of said extension.

12. The ski binding as defined by claim 9 wherein said retention means comprises a projection rib adapted to cooperate with a corresponding groove in said shoe, the height of said projection being selected to prevent substantial torsional movement of said shoe until said shoe heel is lifted to said predetermined extent.

13. The ski binding as defined by claim 3 further comprising an arch adapted to be pivotably mounted on said ski, and wherein said extension comprises a parallelpipedic portion, said arch being configured to seat said parallelpipedic portion therein.

14. The ski binding as defined by claim 13 wherein said extension and said arch comprise corresponding orifices, said binding further comprising a pin adapted to pass through said orifices to secure said parallelpipedic portion of said extension within said arch.

15. The ski binding as defined by claim 14 wherein said arch is adapted to be pivotably secured onto said ski.

16. The ski binding as defined by claim 15 further comprising centering means for centering said arch relative to said ski, said centering means comprising a plate on which said arch is pivotably mounted, said plate comprising a seat and a spring-biased bearing adapted to be positioned in said seat when said arch is centered while allowing torsional movement of said arch relative to said ski when said extension is subjected to a torsional force sufficient to overcome the bias on said bearing.

17. The ski binding as defined by claim 16 further comprising upstanding diverging lateral walls adapted to prevent pivoting of said shoe until after said heel is raised by said predetermined amount.

18. The ski binding as defined by claim 17 wherein said upstanding lateral walls are adapted to be fixed relative to said ski.

19. The ski binding as defined by claim 16 comprising a projection rib adapted to be mounted on said ski, said projection rib being adapted to be seated within a corresponding groove on the bottom of the sole of said shoe, the height of said rib being selected to permit said torsional movement of said shoe after said heel has been lifted by said predetermined extent.

20. The ski binding as defined by claim 3 further comprising a flexion blade adapted to be secured onto said shoe, said flexion blade to be attached to a pivotable body, said pivotable body being adapted to be pivotably mounted on said ski.

21. The ski binding as defined by claim 20 wherein said pivotable body comprises a spring-biased bearing adapted to be seated in a seat fixed relative to said ski.

22. The ski binding as defined by claim 21 further comprising upstanding lateral walls adapted to be fixedly secured to said ski to prevent said torsional movement of said shoe until said heel is lifted sufficiently to raise the heel of said shoe to clear said lateral upstanding walls.

23. The ski binding as defined by claim 22 further comprising a projection rib adapted to be fixedly secured to said ski and adapted to be seated in a corresponding groove on the bottom of the sole of said shoe, said rib having a height selected to prevent said torsional movement of said shoe until said heel is lifted to said predetermined extent.

24. The ski binding as defined by claim 3 further comprising a toe-plate adapted to be secured to said shoe.

25. The ski binding as defined by claim 24 further comprising a spring-biased piston adapted to be mounted on said ski, said toe-plate being adapted to be positioned on said ski whereby said piston is biased against a depression on said toe-plate, said toe-plate further comprising means adapted to cooperate with a sole plate adapted to be mounted on said ski whereby the pressure of said piston against said toe-plate releasably secures said shoe to said ski.

26. The ski binding as defined by claim 25 further comprising a projection rib adapted to be mounted to said ski, said projection rib adapted to cooperate with a corresponding groove on the bottom of the sole of said shoe to retain said shoe against torsional movement until said heel is lifted to said predetermined extent.

27. The ski binding as defined by claim 26 wherein said toe-plate comprises two projections extending beneath said sole plate, each of said projections being positioned symmetrically on opposite sides of the longitudinal plane of symmetry of said ski.

28. The ski binding as defined by claim 2 comprising a projection rib adapted to be mounted longitudinally on said ski, and further adapted to cooperate with a groove on the bottom of the sole of said shoe to prevent substantial torsional movement until said heel has been lifted to said predetermined extent.

29. The ski binding as defined by claim 2 comprising a groove adapted to extend longitudinally along said ski, said groove being adapted to seat a projection rib mounted on the bottom of the sole of said shoe to prevent substantial torsional movement until said heel has been lifted to said predetermined extent.

30. The ski binding as defined by claim 28 or 29 wherein said projection rib and said groove have a substantially triangular cross-section.

31. The ski binding as defined by claim 28 or 29 wherein said projection rib and said groove have a substantially parallelpipedic cross-section.

32. The ski binding as defined by claim 2 comprising pointed projections adapted to be mounted on said ski and a pad of soft material adapted to be mounted under the heel of said shoe, said pointed projections being adapted to embed within said pad due to the weight of the skier to prevent substantial torsional movement until said heel has been lifted to said predetermined extent.

33. The ski binding as defined by claim 1 in combination with said shoe.

34. The ski binding as defined by claim 1 wherein said shoe comprises means preventing substantial torsion of said shoe until said heel has been lifted to a predetermined extent.

35. The ski binding as defined by claim 33 wherein said shoe comprises a longitudinal groove adapted to seat a projection rib affixed to said ski.

36. The ski binding as defined by claim 33 wherein said groove is adapted to completely seat the upper surface of said ski.

37. The ski binding as defined by claim 33 wherein said shoe comprises a longitudinal projection rib adapted to be seated in a corresponding groove in said ski.

38. The ski binding as defined by claim 1 wherein said binding is adapted to secure the front of said shoe to said ski.

39. A cross-country ski binding comprising means for securing the front of a ski shoe to a ski and further comprising means for permitting substantially free torsional movement of a ski shoe relative to a ski around a vertical axis of said binding only after the heel of said shoe has been lifted to a predetermined extent.

* * * * *